United States Patent [19]

Tooley

[11] 4,056,254

[45] * Nov. 1, 1977

[54] SUPPORTS OR CONCRETE FORMWORK

[75] Inventor: Jack Raymond Tooley, New Malden, England

[73] Assignee: Acrow (Engineers) Limited, London, England

[ * ] Notice: The portion of the term of this patent subsequent to Oct. 28, 1992, has been disclaimed.

[21] Appl. No.: 650,449

[22] Filed: Jan. 19, 1976

[30] Foreign Application Priority Data

Jan. 20, 1975 United Kingdom ..... 2418/75

[51] Int. Cl.[2] ..... E04G 17/14; E04G 25/06

[52] U.S. Cl. ..... 249/210; 248/354 S; 249/18

[58] Field of Search ..... 249/13, 18, 26, 28–32, 249/187–188, 205, 207, 210; 248/354 R, 354 S

[56] References Cited

U.S. PATENT DOCUMENTS

| | | | |
|---|---|---|---|
| 3,239,188 | 3/1966 | Gostling | 249/18 |
| 3,292,891 | 12/1966 | Williams | 249/29 |
| 3,614,048 | 10/1971 | Young | 249/210 |
| 3,655,161 | 4/1972 | Schueler | 248/354 S |
| 3,784,151 | 1/1974 | Steele | 249/28 |
| 3,915,423 | 10/1975 | Tooley | 249/210 |

FOREIGN PATENT DOCUMENTS

| | | | |
|---|---|---|---|
| 368,610 | 5/1963 | Switzerland | 248/354 S |
| 1,191,578 | 5/1970 | United Kingdom | 249/18 |

*Primary Examiner*—Francis S. Husar
*Assistant Examiner*—John McQuade
*Attorney, Agent, or Firm*—Wood, Herron & Evans

[57] ABSTRACT

A fitment for a prop, comprising a head plate, which is connected to the prop body of a standard builder's prop, or to a base plate which is intended for connection to a head plate of a standard prop, by a shank, the shank carrying a support tube and a shuttering element support member, the support tube being rotatable around the shank and the support tube or shank being provided with a screw thread engaging with a correspondingly screwed nut secured to, or forming part of, the shank or support tube respectively, the arrangement being such that rotation of the support tube around the shank raises or lowers the support tube relative to the head plate, the shuttering element support being positioned between the head plate and the support tube, the arrangement being such that the shuttering element support is supported by the support tube in one angular position of the support tube relative to the shank and, in a second angular or "strip" position thereof, being free to slide over the support tube.

5 Claims, 3 Drawing Figures

SUPPORTS OR CONCRETE FORMWORK

Figure 1:
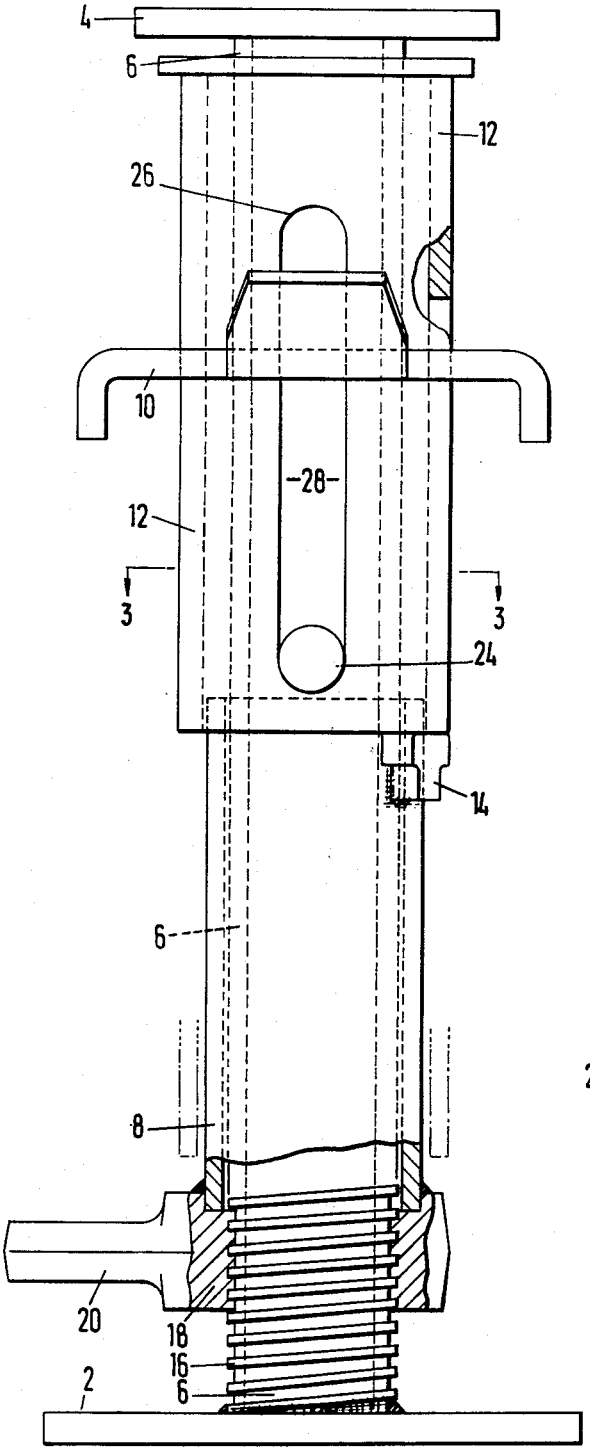

This invention relates to supports for shuttering elements used during the construction of concrete (or the like) roofs, floors and ceilings, or similar soffits, and comprises an improvement in, or modification of, a fitment for a prop, forming the subject of my U.S. Pat. No. 3,915,423.

Normally shuttering in the form of formwork panels onto which concrete and the like is cast, is supported by beams which extend between extensible props. When the concrete is set the props are removed and the beams and panels can be taken away for re-use. It is, however, desirable for at least the beams and panels to be re-used as quickly as possible and accordingly it is the general object of this invention to provide a prop construction for the support of formwork or shuttering elements which enables the beams and panels to be removed prior to complete setting of the concrete, the partially set concrete being directly supported by the props at spaced intervals.

This general object is achieved in accordance with the invention of my U.S. Pat. No. 3,915,423 by a prop, or a fitment for a prop, comprising a head plate which is connected to the prop body or to a base plate to be secured to a standard prop head plate, by a shank preferably of circular cross-section tube or solid, the shank carrying a support tube and a shuttering element support member, the support tube being rotatable around the shank, and the support tube or shank being formed with an angularly inclined surface to engage a corresponding member fixed to and extending from the shank or support tube respectively, the arrangement being such that relative rotation of the support tube around the shank raises or lowers the support tube relative to the head plate, the shuttering element support being positioned between the head plate and the support tube and being so formed and arranged as to be supported by the support tube in one angular position thereof and, in a second angular or "strip" position thereof, being free to slide over the support tube.

In a prop fitment in accordance with this invention the angularly inclined surface on the support tube or shank is in the form of a screw thread which is engaged by a correspondingly screwed "nut" secured to, or forming part of, the shank or support tube respectively.

Thus, if in use, the shuttering element support member carries a beam on which concrete formwork panels rest then the dimensions of the various members will be such that in the erected or upper position of the shuttering element support member, the upper faces of the panels are aligned with the upper face of the main plate of the prop fitment. On turning of the support tube about the main shank, the support tube and hence the shuttering element support member is firstly lowered gradually to strip the formwork panels from beneath the partially set concrete, the concrete remaining supported by the head of the fitment and on further turning of the support tube to the "stripped" position the shuttering element support member, and hence the beams and panels supported thereby fall down over the support tube rapidly, to complete the stripping of the shuttering to a position in which the beams and panels can be disengaged for re-use elsewhere.

Preferably the support tube is provided with outwardly extending lugs or ears on which the shuttering element support member rests in the casting position, the shuttering element support member being formed with a corresponding slot or slots so that when the lugs or ears are aligned with the slot or slots in the "stripped" position as a result of turning of the support tube about the shank, the shuttering support member can fall down over the support tube to enable the formwork beam and panels to be removed.

The downward movement of the support member over the support tube is preferably limited by a pin or pins or the like projecting from the underlying shank and engaging in a slot or slots in an upwardly extending tubular portion of the shuttering element support member.

Figure 2:
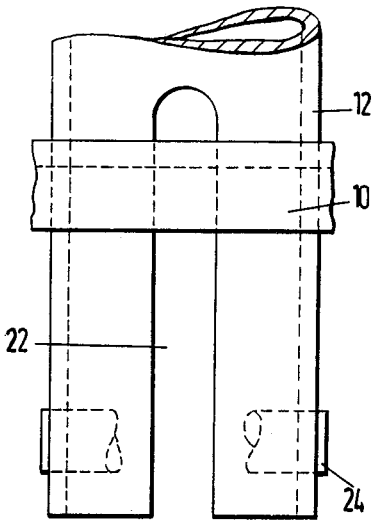
Figure 3:
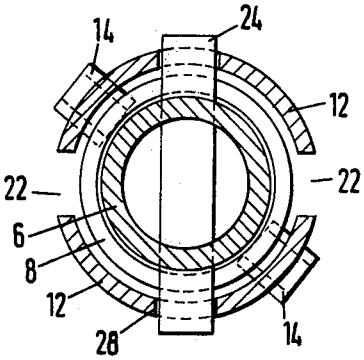

The invention will now be further described by way of example with reference to the accompanying drawings in which:

FIG. 1 is an elevation of a fitment in accordance with the invention for attachment to the top of a standard extensible prop, showing the parts in the erected position, FIG. 2 is a view taken at right angles to FIG. 1 showing the top portion of the fitment, and FIG. 3 is a section on the line 3—3 of FIG. 1.

The fitment shown in the drawings is intended for connection to the standard top plate of a standard extensible prop (not shown) the arrangement being such that the base plate 2 is bolted to the top plate of the prop. Alternatively, the fitment shown in the drawings may be fabricated as an integral part of a standard extensible prop (not shown) at the top end thereof.

The head plate 4 of the fitment is connected to the base plate 2 by means of a tubular shank 6 and a support tube 8 is mounted on the shank 6 and is free for limited rotation thereabout. A shuttering beam support member 10 having a shuttering tube in the form of tubular body 12 is located over the shank 6 adjacent the head plate 4 with the underside of the body 12 resting on locater means in the form of two ears 14 extending outwardly from the support tube 8.

A support beam (not illustrated) rests on the plate 10 at each side thereof and carries concrete formwork panels in known fashion, the upper surface of the panels being aligned with the upper surface of the head plate 4 of the prop fitment. The other end of the beams are supported by other similar prop fitments and other beams may be similarly supported to form the desired area of supported formwork panels.

The bottom portion of the shank 6 adjacent the base plate 2 is formed with a screw thread which is engaged by corresponding screw thread cut in the inside surface of a "nut" 18 is secured to, or forms part of, the bottom of the support tube 8. When the parts are in the correct position, as shown in FIG. 1, the support tube 8 is in a position in which it is held by the screw 16 above the base plate 2 to the maximum extent.

Concrete may then be cast on to the top surface of the formwork panels and over the head plates 4 of the prop fitments.

When it is desired to strip the formwork panels from concrete which has been cast and previously set, a handle 20 projecting from the outer surface of the nut 18 is used to turn the nut and support tube 8 through about 140° around the shank 6 of each prop fitment, thereby lowering shuttering tube 12 from a full support position shown in solid lines in FIGS. 1 and 3 to a preliminary strip position (not shown). During this angular movement the support tube 8, due to the inclination of the screw thread 16 is gradually lowered over the shank 6 causing a similar gradual lowering of the support member 10 and hence of the beams and panels supported by the member 10 relative to the head plate 4 of the fitting and relative to the cast and semi-set concrete. This movement therefore achieves a gradual initial stripping of the panels from the concrete leaving the concrete supported by the head plates 4 of the prop member.

At the end of the 140° movement, i.e., at the preliminary strip position, the ears 14 are aligned with slots 22 (see FIG. 2) extending upwardly through the tubular portion 12 of the shuttering element support member at each side thereof and the shuttering element support member can then drop over the support tube with ears 14 passing up within the slots 22 into the full strip position shown in phantom lines in FIG. 1.

The extent of the downward movement of the support member is limited by, i.e., the full strip position is defined by, the engagement of a pin 24, extending out from the shank 6, with the top surface 26 of a slot 28 formed in the tubular extension 12 of the support member 10, the slots 28 being positioned at 90° to the slots 22. Pin 24 and slot 28 also cooperate to prevent the shuttering tube 12 from rotating as the support tube 8 is rotated, i.e., those elements 24, 28 also function as anti-rotation means.

In the full stripped or collapsed position of the parts the beams and panels can readily be removed from the support 10 for re-use elsewhere leaving the partially set concrete still supported by the head plate 4 of the various prop fitments.

It will, of course, be appreciated that the relative position of the ears 14 and slots 22, i.e., the locater means, could be reversed in that the tube 8 could be provided with slots and the support member be provided with ears or lugs, the important feature being that relative rotation of the support tube and support member achieves an initial gradual downward movement of the support member relative to the head plate 4 with a subsequent rapid downward movement of the support member to a collapsed or stripped position.

The support member 10 may be secured to the tube 12 at any position along its length to fit the dimensions of beams and panels and need not be located at the bottom of the tubular portion.

It will also be appreciated that the tube 6 may form the upper member of an extensible prop and the base plate 2 will in such case be unnecessary.

I claim:

1. A fitment for a prop, said fitment being adapted to support at least one shuttering element of the type used with concrete formwork, said fitment being adjustable between a full support position, and preliminary and full strip positions, said fitment comprising a shank connectable at one end to a prop, a shuttering tube longitudinally slidable in coaxial relation with said shank, said shuttering tube mounting at least one shuttering support member thereon, a support tube rotatably disposed in coaxial relation with said shank, locater means carried partially on said support tube and partially on said shuttering tube, said locater means being operative in a first rotational position of said support tube to maintain said shuttering tube in said full support position and said locater means being inoperative to maintain said shuttering tube in said full support position when in a second rotational position of said support tube, said locater means permitting said shuttering tube to drop into said full strip position when in said second rotational position, and screw threads on said shank and said support tube and connecting said shank and said support tube together in threaded relation, rotation of said support tube relative to said shank while said locater means is in said first rotational position causing said shuttering tube to move between said full support position and said preliminary strip position in response to said threaded relation between said shank and said support tube, and rotation of said support tube relative to said shank which causes said locater means to move into said second rotational position also permitting said shuttering tube to drop into said full strip position in response to the inoperativeness of said locater means at said second rotational position.

2. A fitment as set forth in claim 1, said locater means including at least one support ear mounted to one of said support tube and said shuttering tube and extending substantially radially therefrom, and the other of said support tube and said shuttering tube defining at least one slot adapted to receive said support ear therein, said support ear cooperating with a contact surface on that tube to which said ear is not fixed to maintain said support and shuttering tubes in the full support position throughout said first rotational position, and said support ear being aligned with said slot to permit said shuttering tube to drop into the full strip position at said second rotational position.

3. A fitment as set forth in claim 1 including anti-rotation means interconnecting said shank and said shuttering tube, said anti-rotation permitting sliding motion of said shuttering tube relative to said shank but preventing rotational motion of said shuttering tube relative to said shank.

4. A fitment as set forth in claim 3, said anti-rotation means comprising an anti-rotation slot defined in one of said shank and said shuttering tube, and an anti-rotation pin fixed to the other of said shank and said shuttering tube, said anti-rotation pin being received in said anti-rotation slot.

5. A fitment as set forth in claim 3, said fitment's full strip position being established by one of said locater means structure and said anti-rotation means structure.

* * * * *

UNITED STATES PATENT AND TRADEMARK OFFICE

CERTIFICATE OF CORRECTION

PATENT NO. : 4,056,254
DATED : November 1, 1977
INVENTOR(S) : Jack Raymond Tooley It is certified that error appears in the above-identified patent and that said Letters Patent are hereby corrected as shown below:

Column 4, line 46, after "anti-rotation" insert -- means --

Signed and Sealed this

*Twenty-first* Day of *February 1978*

[SEAL]

*Attest:*

RUTH C. MASON
*Attesting Officer*

LUTRELLE F. PARKER
*Acting Commissioner of Patents and Trademarks*